US007554492B2

(12) United States Patent
Cheng

(10) Patent No.: US 7,554,492 B2
(45) Date of Patent: Jun. 30, 2009

(54) PRINTED ANTENNA AND PRINTED ANTENNA MODULE

(75) Inventor: Shih-Chieh Cheng, Tainan County (TW)

(73) Assignee: Arcadyan Technology Corporation, Hsinchu (TW)

( * ) Notice: Subject to any disclaimer, the term of this patent is extended or adjusted under 35 U.S.C. 154(b) by 153 days.

(21) Appl. No.: 11/882,038

(22) Filed: Jul. 30, 2007

(65) Prior Publication Data

US 2008/0084353 A1 Apr. 10, 2008

(30) Foreign Application Priority Data

Oct. 5, 2006 (TW) ..... 95137232 A
Oct. 31, 2006 (CH) ..... 2006 1 0137648

(51) Int. Cl.
*H01Q 1/38* (2006.01)
*H01Q 1/48* (2006.01)

(52) U.S. Cl. ..... 343/700 MS; 343/846

(58) Field of Classification Search ..... 343/700 MS, 343/702, 846, 848, 873
See application file for complete search history.

(56) References Cited

U.S. PATENT DOCUMENTS 5,982,332 A * 11/1999 Lewis, Jr. ..... 343/749
6,476,767 B2 * 11/2002 Aoyama et al. ..... 343/700 MS
2007/0139270 A1 * 6/2007 Takei et al. ..... 343/700 MS

* cited by examiner

*Primary Examiner*—Shih-Chao Chen
(74) *Attorney, Agent, or Firm*—Birch, Stewart, Kolasch & Birch, LLP

(57) ABSTRACT

A printed antenna includes a radiating portion, a capacitance matching portion, an inductance matching portion, a feeding portion and a grounding portion. The capacitance matching portion is disposed parallel to the radiating portion. One end of the inductance matching portion is electrically connected with the radiating portion, and the other end of the inductance matching portion is electrically connected with the capacitance matching portion. The feeding portion, which is electrically connected with one inner side of the inductance matching portion, is located among the capacitance matching portion, the inductance matching portion, and the radiating portion. The feeding portion is roughly perpendicular to the radiating portion. The grounding portion is electrically connected with an outer side of the inductance matching portion. In addition, a printed antenna module including several printed antennas is also disclosed.

20 Claims, 8 Drawing Sheets

2

PRINTED ANTENNA AND PRINTED ANTENNA MODULE

BACKGROUND OF THE INVENTION

1. Field of Invention

The invention relates to an antenna, and, in particular, to a printed antenna and a printed antenna module.

2. Related Art

The rapidly developed radio transmission has brought various products and technologies applied in the field of multi-band transmission, such that many new products have the performance of radio transmission to meet the consumer's requirement. The antenna is an important element for transmitting and receiving electromagnetic wave energy in the radio transmission system. If the antenna is lost, the radio transmission system cannot transmit and receive data. Thus, the antenna plays an indispensable role in the radio transmission system.

In the radio transmission system, the currently used frequency band specifications include IEEE 802.11, IEEE 802.15.1 (bluetooth communication), and the like. IEEE 802.11 is further divided into the specifications of IEEE 802.11a, IEEE 802.11b and IEEE 802.11g. IEEE 802.11a is the specification corresponding to the frequency band of 5 GHz. IEEE 802.11b and IEEE 802.11g are the specifications corresponding to the frequency band of 2.4 GHz. IEEE 802.15.1 is also the specification corresponding to the frequency band of 2.4 GHz.

To meet the above-mentioned specifications, the printed antenna is frequently used. As shown in FIG. 1, a conventional printed antenna 1 includes a substrate 11, a grounding portion 12, a radiating portion 13 and a feeding portion 14. The substrate 11 has a surface 111, on which the grounding portion 12, the radiating portion 13 and the feeding portion 14 are disposed. The grounding portion 12 is electrically connected with the radiating portion 13. The feeding portion 14 disposed in parallel to the grounding portion 12 is electrically connected with the radiating portion 13.

In addition, the peak value of the power gain of the printed antenna 1 is about 2 to 3 dBi. However, the power gain provided by the current printed antenna 1 is insufficient and thus induces some problems as the consumers gradually pay attention to the communication quality. For example, because the power gain of the printed antenna 1 is not large enough, the manufacturer typically enhances the signal receiving and transmitting ability of the printed antenna 1 by amplifying the information that is received or transmitted by the printed antenna 1. However, the received or transmitted noise is correspondingly amplified, and the communication quality cannot be enhanced and the power loss is also increased. Also, if the printed antenna 1 is used in the diversity application such as the spatial diversity, the polarized diversity or the radiation pattern diversity, the correlation between the channels in the space is too great, and the communication quality is thus deteriorated.

Thus, it is an important subject of the invention to provide a printed antenna with an enhanced power gain.

SUMMARY OF THE INVENTION

In view of the foregoing, the invention is to provide a printed antenna and a printed antenna module with an enhanced power gain.

To achieve the above, the invention discloses a printed antenna including a radiating portion, a capacitance matching portion, an inductance matching portion, a feeding portion and a grounding portion. The capacitance matching portion is disposed parallel to the radiating portion. One end of the inductance matching portion is electrically connected with the radiating portion, and the other end of the inductance matching portion is electrically connected with the capacitance matching portion. The feeding portion electrically connected with an inner side of the inductance matching portion is located among the capacitance matching portion, the inductance matching portion and the radiating portion. The feeding portion is roughly perpendicular to the radiating portion. The grounding portion is electrically connected with an outer side of the inductance matching portion.

To achieve the above, the invention also discloses a printed antenna module including a plurality of radiating portions, a plurality of capacitance matching portions, a plurality of feeding portions, and a grounding portion. The capacitance matching portions are disposed parallel to the radiating portions, respectively. Each of the inductance matching portions has one end electrically connected with one corresponding radiating portion and the other end electrically connected with one corresponding capacitance matching portion. Each of the feeding portions is electrically connected with an inner side of one corresponding inductance matching portion and located among the corresponding capacitance matching portion, inductance matching portion and radiating portion. The feeding portions are roughly perpendicular to the corresponding radiating portions. The grounding portion is electrically connected with outer sides of the inductance matching portions.

As mentioned above, the printed antenna and printed antenna module according to the invention have the grounding portion electrically connected with the outer side(s) of the inductance matching portion(s). In other words, the grounding portion is electrically connected with the radiating portion(s) and the capacitance matching portion(s) through the inductance matching portion(s). Compared with the prior art printed antenna, in which the grounding portion is only electrically connected with one end of the radiating portion, the electrical connection region between the grounding portion of the printed antenna and the inductance matching portion in this invention is larger than that between the grounding portion of the printed antenna and one end of the radiating portion in prior art. Therefore, the power gain of the printed antenna and printed antenna module of the invention is greater than the power gain of the conventional printed antenna, and the communication quality can be enhanced.

BRIEF DESCRIPTION OF THE DRAWINGS

The invention will become more fully understood from the detailed description given herein below illustration only, and thus is not limitative of the present invention, and wherein.

DETAILED DESCRIPTION OF THE INVENTION

The present invention will be apparent from the following detailed description, which proceeds with reference to the accompanying drawings, wherein the same references relate to the same elements.

Figure 1:
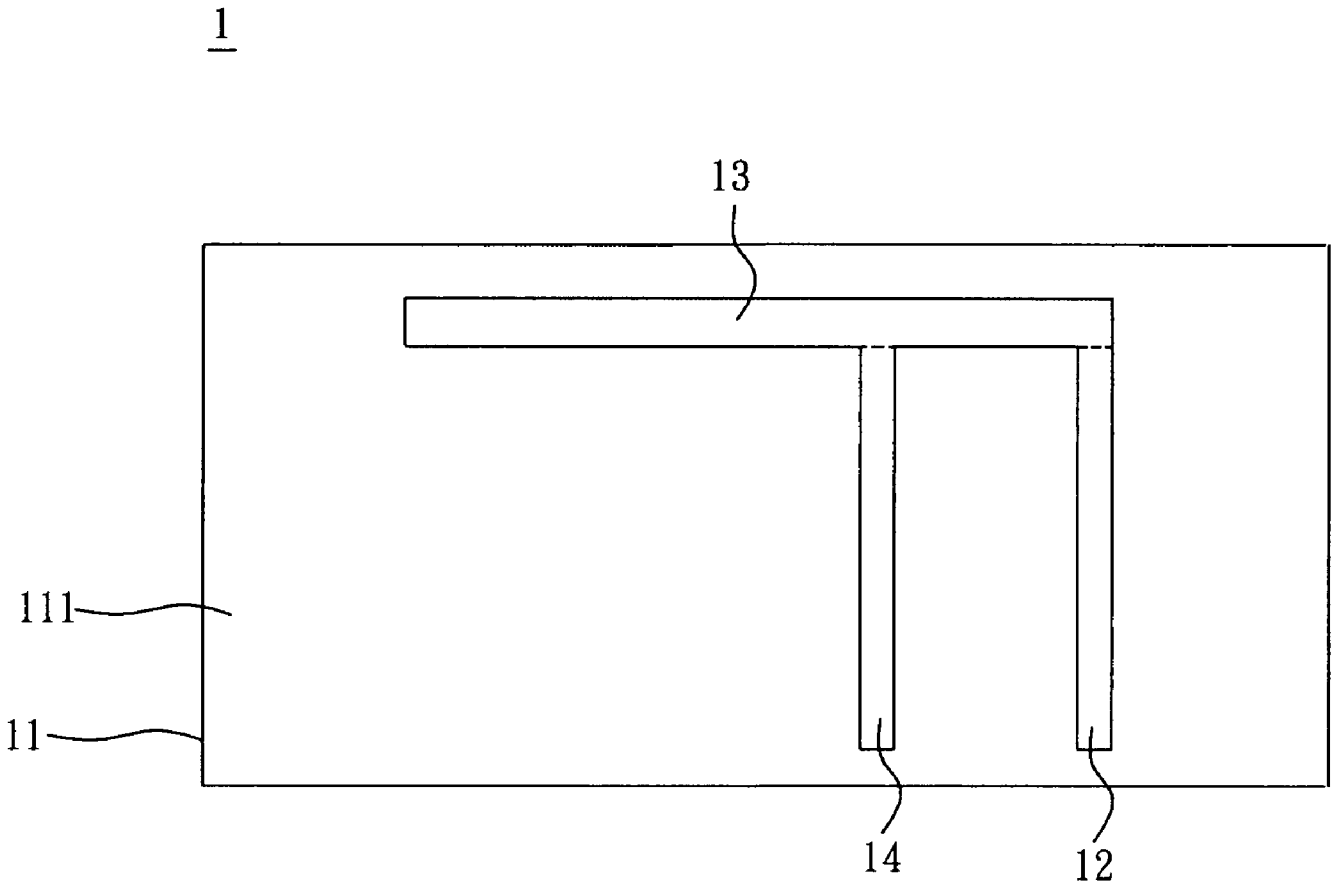
FIG. 1 (PRIOR ART)
FIG. 1 is a schematic illustration showing a conventional printed antenna.
Figure 2:
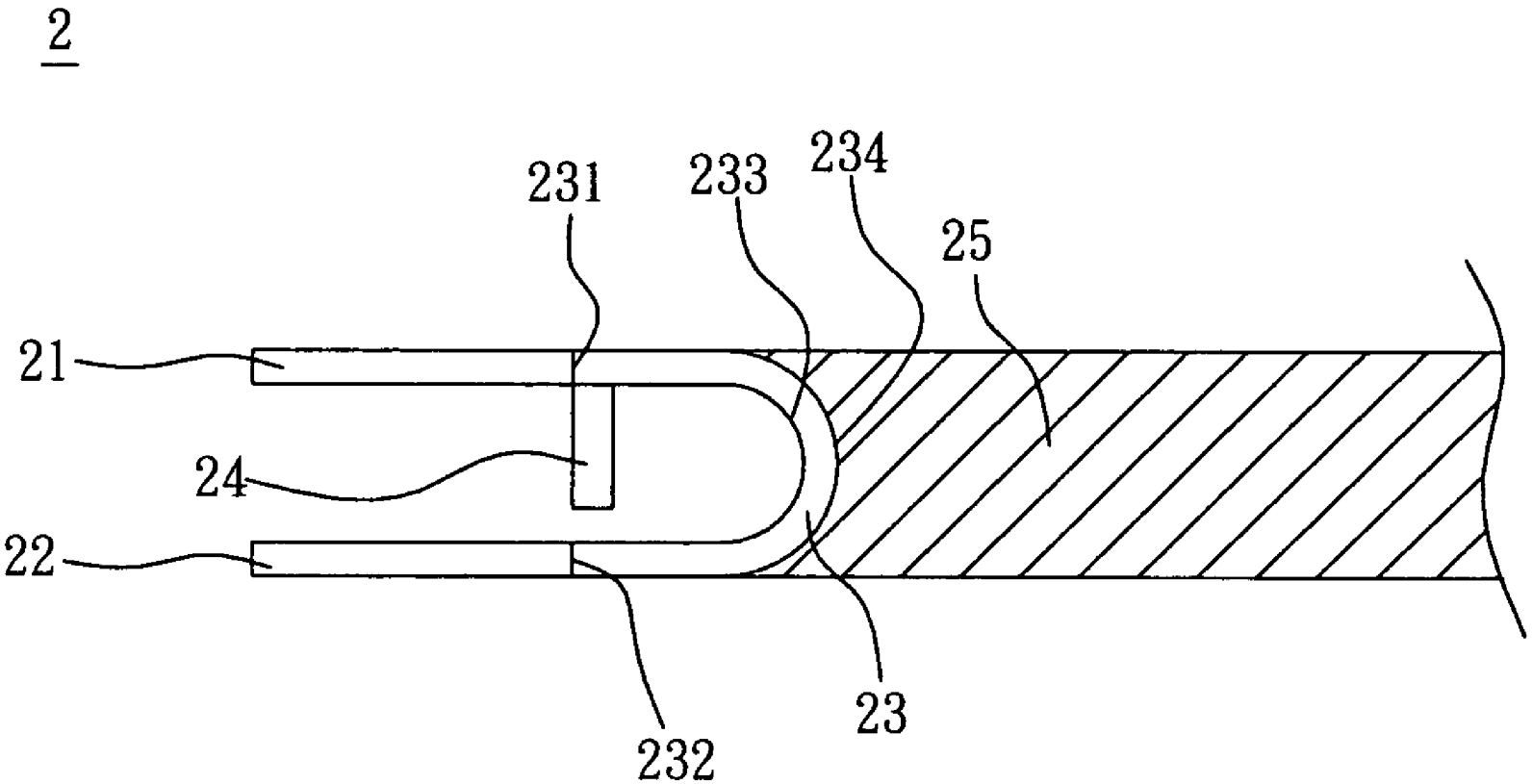
FIG. 2 is a schematic illustration showing a printed antenna according to a first embodiment of the invention.

Referring to FIG. 2, a printed antenna 2 according to the first embodiment of the invention includes a radiating portion 21, a capacitance matching portion 22, an inductance matching portion 23, a feeding portion 24 and a grounding portion 25.

The capacitance matching portion 22 and the radiating portion 21 are disposed opposite to each other. In this embodiment, the capacitance matching portion 22 and the radiating portion 21 are parallel to each other based on that the capacitance effect is generated according to the parallel-plate principle.

The inductance matching portion 23 has one end 231 electrically connected with the radiating portion 21 and the other end 232 electrically connected with the capacitance matching portion 22. The inductance matching portion 23 may have a semi-circular shape, an arched shape or a horseshoe shape. In this embodiment, the inductance matching portion 23 has the horseshoe shape.

The feeding portion 24 is electrically connected with an inner side 233 of the inductance matching portion 23 and located among the capacitance matching portion 22, the inductance matching portion 23 and the radiating portion 21. In this embodiment, the feeding portion 24 is perpendicular to the radiating portion 21.

The grounding portion 25 is electrically connected with an outer side 234 of the inductance matching portion 23. In other words, the grounding portion 25 is electrically connected with the radiating portion 21 and the capacitance matching portion 22 through the outer side 234 of the inductance matching portion 23. Compared with the conventional printed antenna 1, in which the grounding portion 12 is only electrically connected with one end of the radiating portion 13, the electrical connection region between the grounding portion 25 and the outer side 234 of the inductance matching portion 23 in the printed antenna 2 of the invention is larger than the electrical connection region between the grounding portion 12 and the end of the radiating portion 13 in the conventional printed antenna 1.

Figure 3:
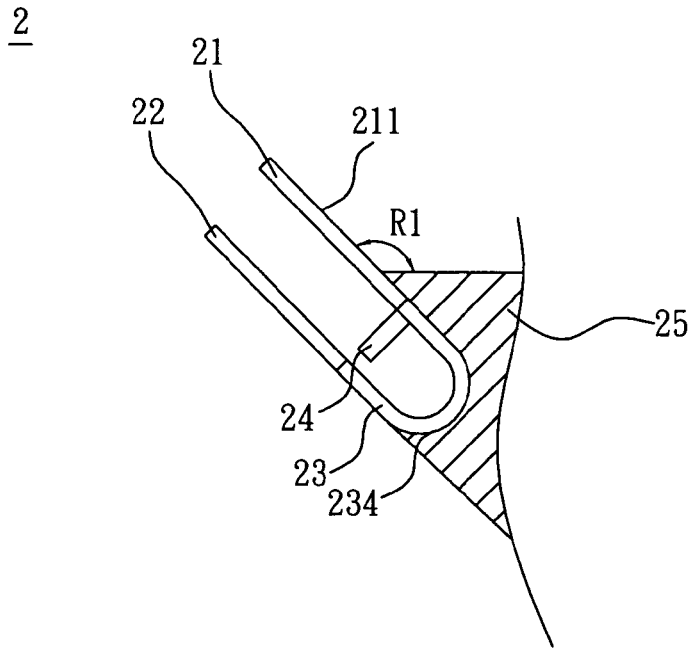
FIG. 3 is a schematic illustration showing an angle between the grounding portion and the radiating portion in the printed antenna of FIG. 2.

As shown in FIG. 3, the grounding portion 25 is further electrically connected to an outer side 211 of the radiating portion 21. In other words, the grounding portion 25 is electrically connected with both the outer side 211 of the radiating portion 21 and the outer side 234 of the inductance matching portion 23 in order to enlarge the electrical connection region. The grounding portion 25 and the outer side 211 of the radiating portion 21 form an angle R1. Herein, the angle R1 is not particularly restricted and may have different parameter values according to the actual conditions. Preferably, the angle R1 is ranged from 0 to 180 degrees.

Figure 4:
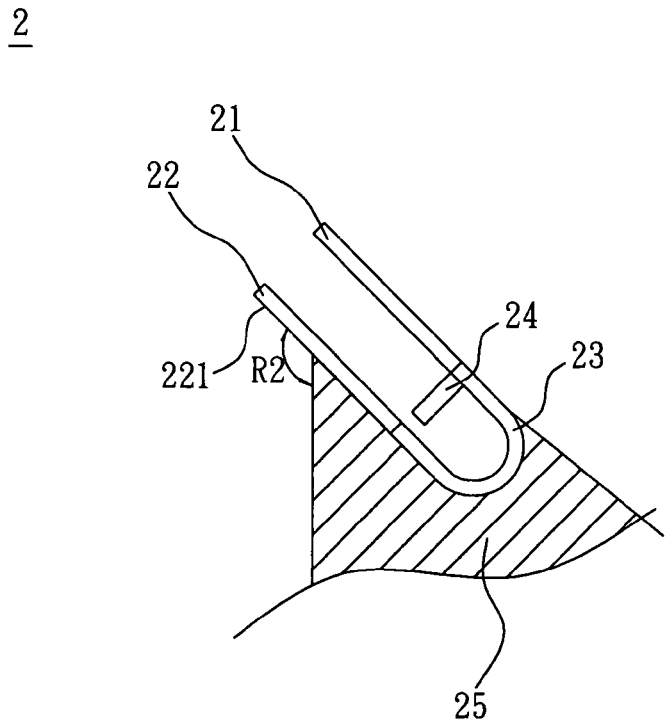
FIG. 4 is a schematic illustration showing an angle between the grounding portion and the inductance matching portion in the printed antenna of FIG. 2.

As shown in FIG. 4, the grounding portion 25 may further be electrically connected with an outer side 221 of the capacitance matching portion 22. In other words, the grounding portion 25 is electrically connected with the outer side 234 of the inductance matching portion 23 and the outer side 221 of the capacitance matching portion 22 so as to enlarge the electrical connection region. The grounding portion 25 and the outer side 221 of the capacitance matching portion 22 form an angle R2. Herein, the angle R2 is not particularly restricted and may have different parameter values according to the actual conditions. Preferably, the angle R2 is ranged from 0 to 180 degrees.

Figure 5:
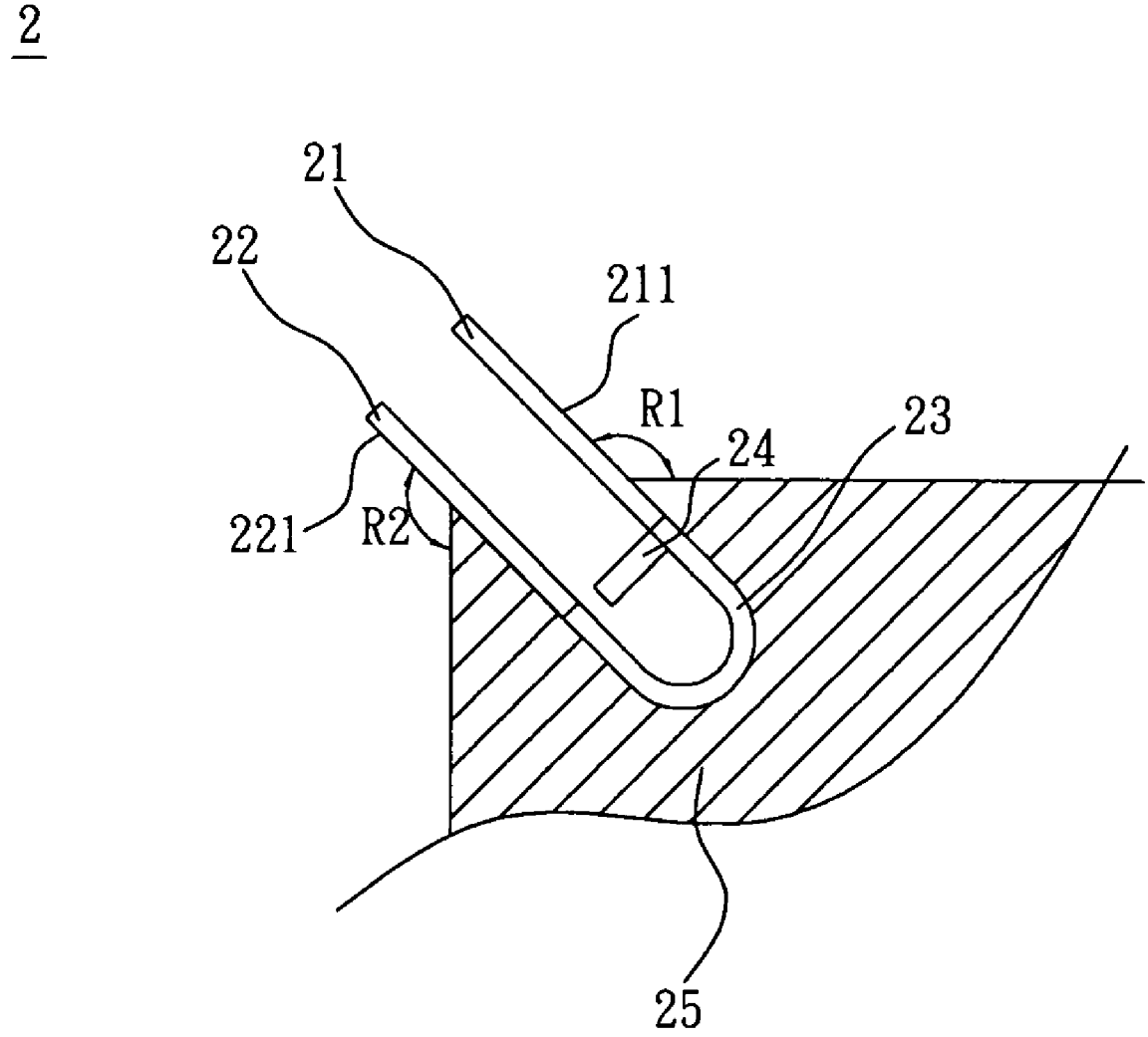
FIG. 5 is a schematic illustration showing an angle between the grounding portion and the radiating portion and an angle between the grounding portion and the inductance matching portion in the printed antenna of FIG. 2.

With reference to FIG. 5, the grounding portion 25 may also be electrically connected with the outer side 211 of the radiating portion 21, the outer side 221 of the capacitance matching portion 22 and the outer side 234 of the inductance matching portion 23.

In this embodiment, the radiating portion 21, the capacitance matching portion 22, the inductance matching portion 23, the feeding portion 24 and the grounding portion 25 are integrally formed. In addition, the radiating portion 21, the capacitance matching portion 22, the inductance matching portion 23, the feeding portion 24 and the grounding portion 25 are made of metal in this embodiment.

Figure 6:
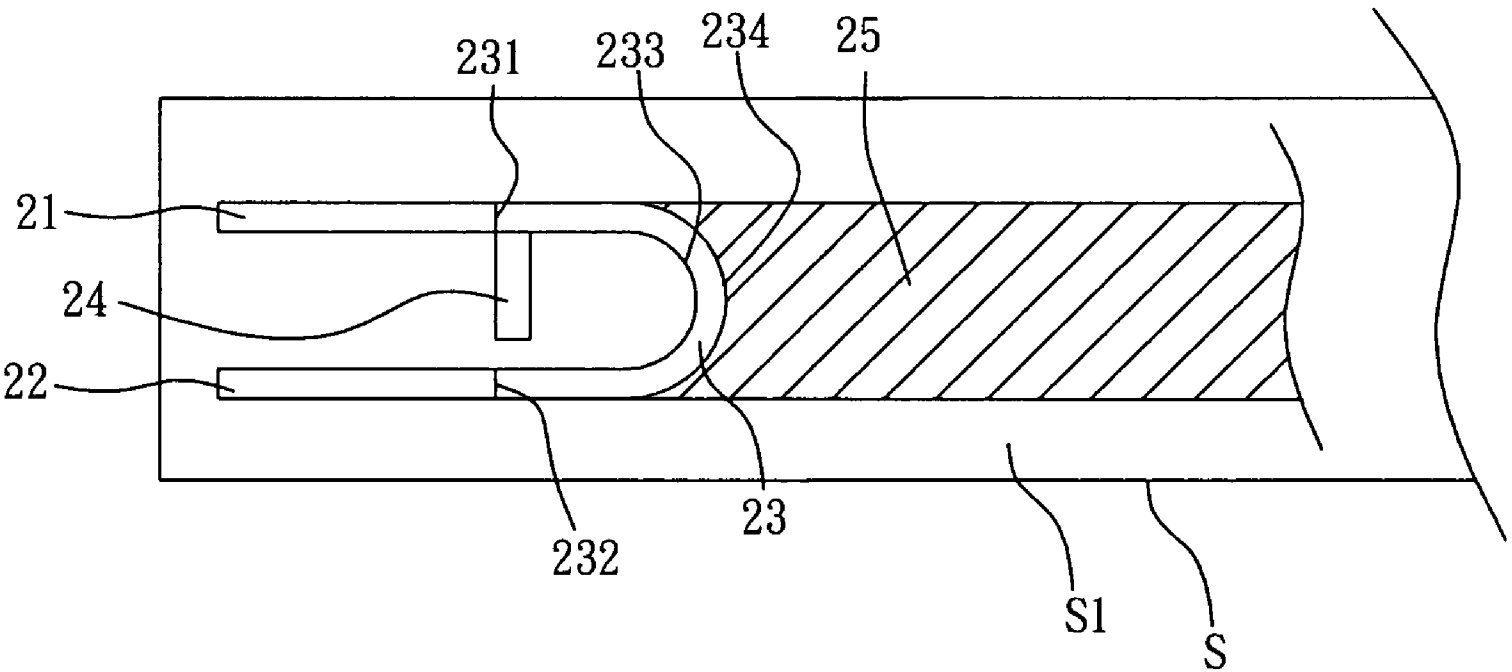
FIG. 6 is a schematic illustration showing a printed antenna according to a second embodiment of the invention.

In addition, referring to FIG. 6, the printed antenna 2 further includes a substrate S having a surface S1, on which the radiating portion 21, the capacitance matching portion 22, the inductance matching portion 23, the feeding portion 24 and the grounding portion 25 are disposed. In this embodiment, the substrate S is a printed circuit board made of a BT resin (Bismaleimide-triazine resin) or a FR4 (Fiberglass reinforced epoxy resin). The substrate S may also be a flexible film substrate made of polyimide.

It is to be noted that the printed antenna 2 may work under different frequency bands, such as the frequency band with the specification of IEEE 802.11, IEEE802.15 or IEEE 802.16 or other frequently used frequency bands according to the actual design in which the dimension of each part or the angle is adjusted. Of course, the printed antenna 2 may be configured to work in the dual-band or multi-band mode according to the actual requirement, and detailed descriptions thereof will be omitted.

In addition, a printed antenna module of the invention will be described herein below. In the embodiment, the printed antenna module includes a plurality of radiating portions, a plurality of capacitance matching portions, a plurality of feeding portions, and a grounding portion. Herein, one radiating portions, one capacitance matching portions, one feeding portions, and the grounding portion may construct a printed antenna.

Figure 7:
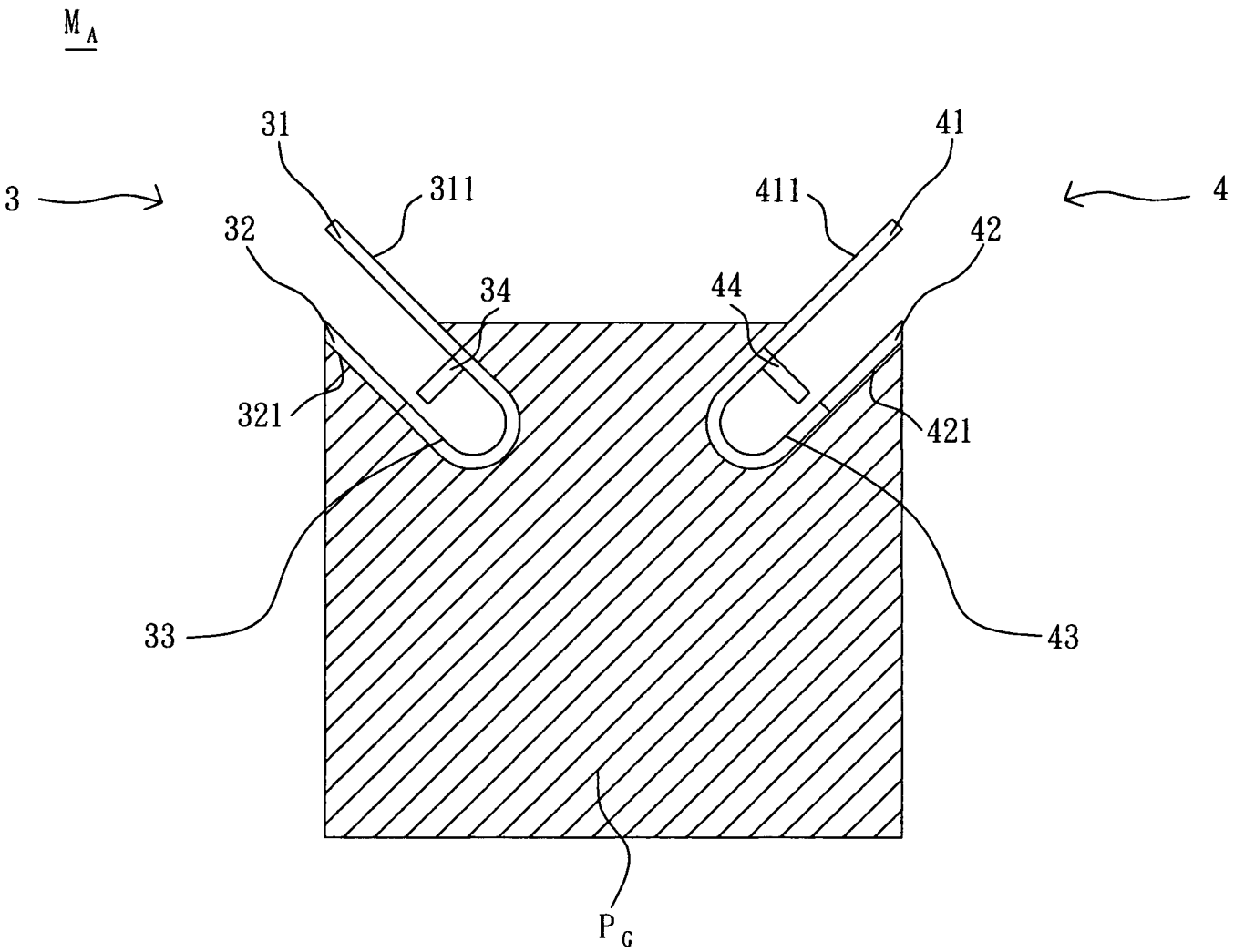
FIG. 7 is a schematic illustration showing a printed antenna according to a third embodiment of the invention.

For example, as shown in FIG. 7, the printed antenna module $M_A$ at least includes a first printed antenna 3 and a second printed antenna 4. The first printed antenna 3 includes a first radiating portion 31, a first capacitance matching portion 32, a first inductance matching portion 33, a first feeding portion 34 and a grounding portion $P_G$. The second printed antenna 4 includes a second radiating portion 41, a second capacitance matching portion 42, a second inductance matching portion 43, a second feeding portion 44 and the grounding portion $P_G$. The structures and aspects of the first radiating portion 31, the first capacitance matching portion 32, the first inductance matching portion 33, and the first feeding portion 34 are the same as those of the radiating portion 21, the capacitance matching portion 22, the inductance matching portion 23, and the feeding portion 24 of the printed antenna 2 as shown in the previous embodiment. The structures and aspects of the second radiating portion 41, the second capacitance matching portion 42, the second inductance matching portion 43, and the second feeding portion 44 are the same as those of the radiating portion 21, the capacitance matching portion 22, the inductance matching portion 23, and the feeding portion 24 of the printed antenna 2 as shown in the previous embodiment. Therefore, the detail descriptions are omitted.

To be noted, the first printed antenna 3 and the second printed antenna 4 commonly have the grounding portion $P_G$. In this embodiment, the first radiating portion 31, the first capacitance matching portion 32, the first inductance matching portion 33, and the first feeding portion 34 can be disposed at any corner of the grounding portion $P_G$, and the second radiating portion 41, the second capacitance matching portion 42, the second inductance matching portion 43, and the second feeding portion 44 can be disposed at any other corner of the grounding portion $P_G$. The inductance matching portion 33 or 43 of the printed antenna 3 or 4 may have a semi-circular shape, an arched shape or a horseshoe shape. The grounding portion $P_G$ is electrically connected with outer sides 311 and 411 of the radiating portions 31 and 41. The grounding portion $P_G$ and the outer side 311 of the radiating portion 31 form an angle, and the grounding portion $P_G$ and the outer side 411 of the radiating portion 41 also form an angle. In the embodiment, the angle(s) is ranged from 0 to 180 degrees. In addition, the grounding portion $P_G$ is further electrically connected with outer sides 321 and 421 of the capacitance matching portion 32 and 42. The grounding portion $P_G$ and the outer side 321 of the capacitance matching portions 32 form an angle, and the grounding portion $P_G$ and the outer side 421 of the capacitance matching portion 42 also form an angle. Herein, the angle(s) is ranged from 0 to 180 degrees. By this way, the signals can be received by the printed antenna module of the invention more reliable. Moreover, the transmitting and receiving power of the printed antenna module of the invention can be increased, and thus the communication quality can be enhanced.

In the embodiment, the second radiating portion 41, the second capacitance matching portion 42, the second inductance matching portion 43, and the second feeding portion 44 are arranged symmetrically to the first radiating portion 31, the first capacitance matching portion 32, the first inductance matching portion 33, and the first feeding portion 34, respectively.

As mentioned above, the printed antenna module $M_A$ is configured with the printed antennas 3 and 4 as shown in the previous embodiment, so the power gain thereof can be increased so as to enhance the communication quality.

Figure 8:
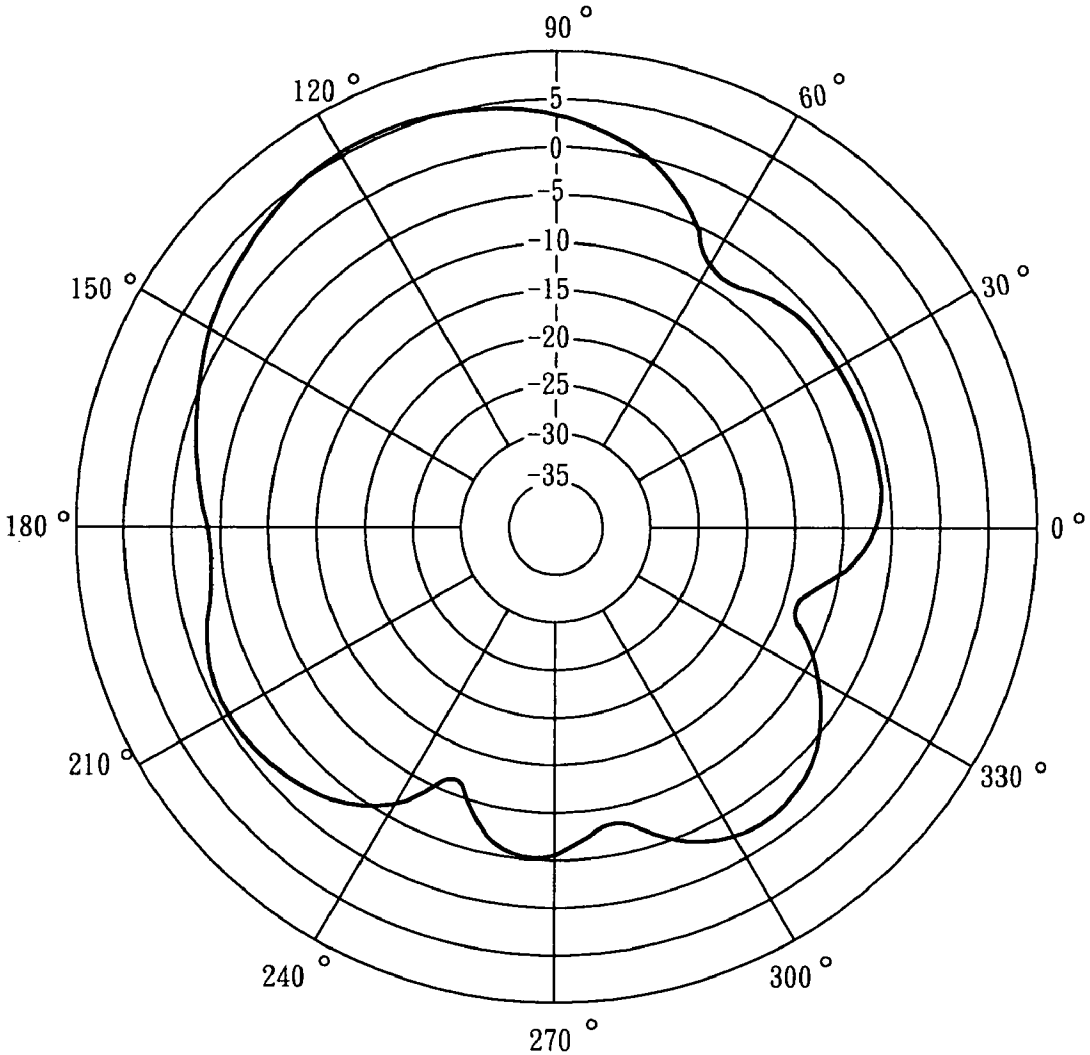
FIG. 8 is a schematic illustration showing the measurement result of the E-Plane radiation pattern when the printed antenna of FIG. 7 works under 2.4 GHz.

FIG. 8 is a schematic illustration showing the measurement result of the E-Plane radiation pattern when the printed antenna module $M_A$ of FIG. 7 works under 2.4 GHz. In the result, it is observed that the peak value of the power gain of the printed antenna module $M_A$ of the invention is about 5.15 dBi. In other words, the peak value (5.15 dBi) of the power gain of the printed antenna module $M_A$ of the invention is greater than the peak value (2 to 3 dBi) of the power gain of the conventional printed antenna 1. Thus, the printed antenna module $M_A$ of the invention can have the enhanced ability of receiving and transmitting signals under the existing operating power. In addition, when the printed antenna module $M_A$ of the invention is used in the diversity technology such as the spatial diversity, the polarized diversity or the radiation pattern diversity, the correlation between the channels in the space can be reduced, and the communication quality can be enhanced.

Of course, it is to be noted that the printed antenna module $M_A$ of the invention is not restricted to the aspects of the above-mentioned embodiment (as shown in FIG. 7), and may have more modified aspects.

Figure 9:
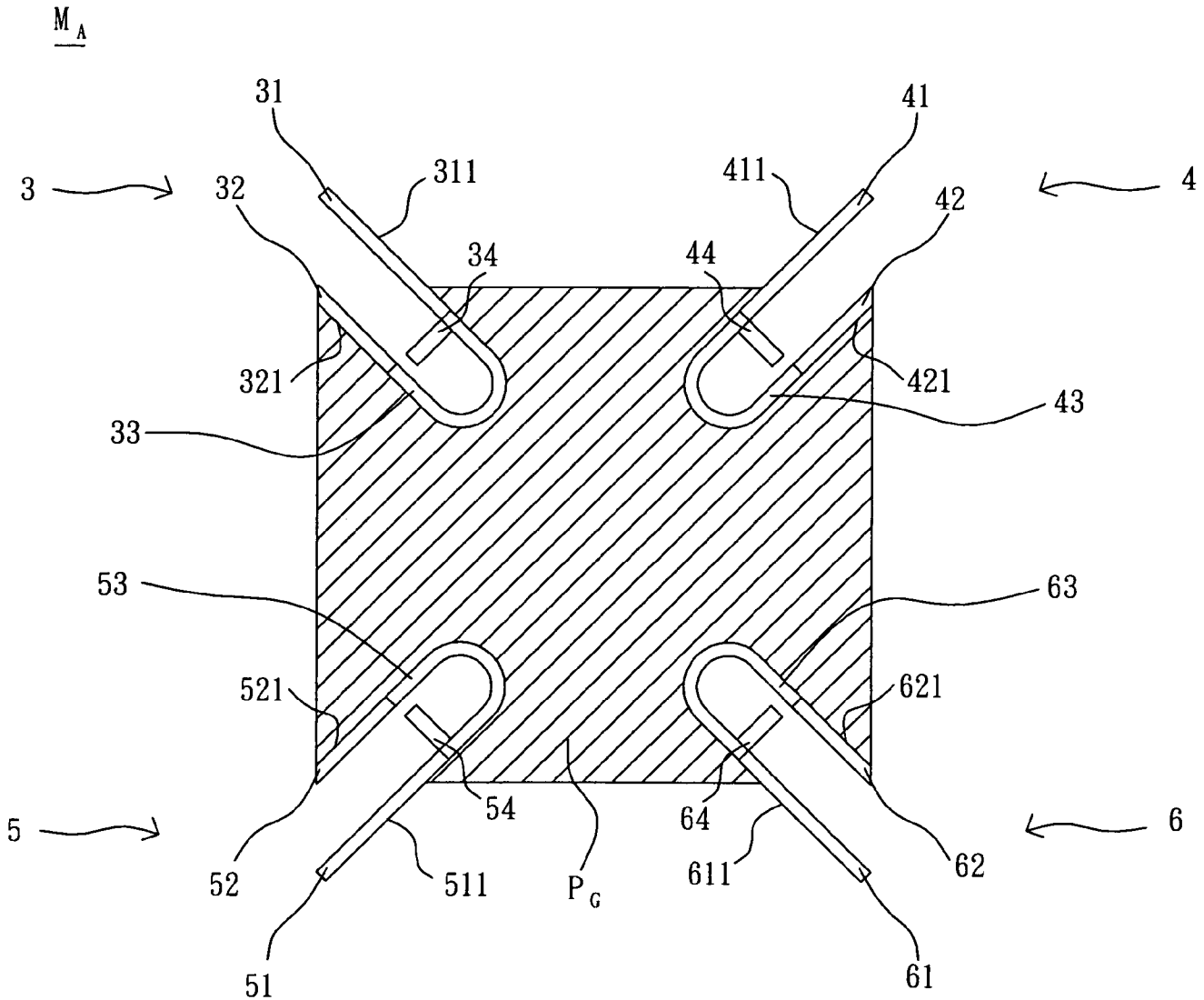
FIG. 9 is a schematic illustration showing a printed antenna according to a fourth embodiment of the invention.

Referring to FIG. 9, the printed antenna module $M_A$ may further include a third printed antenna 5 and a fourth printed antenna 6. The third printed antenna 5 includes a third radiating portion 51, a third capacitance matching portion 52, a third inductance matching portion 53, a third feeding portion 54, and the grounding portion $P_G$, and the fourth printed antenna 6 includes a fourth radiating portion 61, a fourth capacitance matching portion 62, a fourth inductance matching portion 63, a fourth feeding portion 64, and the grounding portion $P_G$.

The structures and aspects of the third radiating portion 51, the third capacitance matching portion 52, the third inductance matching portion 53, the third feeding portion 54, the fourth radiating portion 61, the fourth capacitance matching portion 62, the fourth inductance matching portion 63, and the fourth feeding portion 64 are the same as those of the first radiating portion 31, the first capacitance matching portion 32, the first inductance matching portion 33, the first feeding portion 34, the second radiating portion 41, the second capacitance matching portion 42, the second inductance matching portion 43, and the second feeding portion 44, so the detailed descriptions thereof will be omitted. The third radiating portion 51, the third capacitance matching portion 52, the third inductance matching portion 53, the third feeding portion 54, the fourth radiating portion 61, the fourth capacitance matching portion 62, the fourth inductance matching portion 63 and the fourth feeding portion 64 are arranged symmetrically to the first radiating portion 31, the first capacitance matching portion 32, the first inductance matching portion 33, the first feeding portion 34, the second radiating portion 41, the second capacitance matching portion 42, the second inductance matching portion 43 and the second feeding portion 44, respectively. In this embodiment, the first radiating portion 31, first capacitance matching portion 32, first inductance matching portion 33, and first feeding portion 34 of the first printed antenna 3, the second radiating portion 41, second capacitance matching portion 42, second inductance matching portion 43, and second feeding portion 44 of the second printed antenna 4, the third radiating portion 51, third capacitance matching portion 52, third inductance matching portion 53, and third feeding portion 54 of the third printed antenna 5, and the fourth radiating portion 61, fourth capacitance matching portion 62, fourth inductance matching portion 63, and fourth feeding portion 64 of the fourth printed antenna 6 can be disposed at four corners of the grounding portion $P_G$. The inductance matching portion 33, 43, 53 or 63 of the printed antenna 3, 4, 5 or 6 may have a semi-circular shape, an arched shape or a horseshoe shape. The grounding portion $P_G$ is electrically connected with outer sides 311, 411, 511 and 611 of the radiating portions 31, 41, 51 and 61. The grounding portion $P_G$ and each of the outer sides 311, 411, 511 and 611 form an angle, and the angle(s) is ranged from 0 to 180 degrees. In addition, the grounding portion $P_G$ is further electrically connected with outer sides 321, 421, 521 and 621 of the capacitance matching portions 32, 42, 52 and 62. The grounding portion $P_G$ and each of the outer sides 321, 421, 521 and 621 form an angle, and the angle(s) is ranged from 0 to 180 degrees. By this way, the signals can be received by the printed antenna module $M_A$ of the invention more reliable. Moreover, the transmitting and receiving power of the printed antenna module $M_A$ of the invention can be increased, and thus the communication quality can be enhanced.

In the embodiment, the number of the printed antennas in one printed antenna module $M_A$ is, but not limited to, 2 or 4. In practice, the number of the printed antennas can be determined according to the actual needs. Of course, the locations of the printed antennas are not limited to the corners of the grounding portion $P_G$.

As mentioned above, the printed antenna 2 may be an antenna for a wireless communication system, a smart antenna system or a multi-input multi-output system.

In summary, the printed antenna and printed antenna module according to the invention have the grounding portion electrically connected with the outer side(s) of the inductance matching portion(s). In other words, the grounding portion is electrically connected with the radiating portion(s) and the capacitance matching portion(s) through the inductance matching portion(s). Compared with the conventional printed antenna, in which the grounding portion is only electrically connected with one end of the radiating portion, the electrical connection region between the grounding portion of the printed antenna and the inductance matching portion(s) in this invention is larger than that between the grounding portion of the printed antenna and one end of the radiating portion in prior art. Therefore, the power gain (with peak value of 5.15 dBi) of the printed antenna and printed antenna module of the invention is greater than the power gain (with peak value of 2 to 3 dBi) of the conventional printed antenna, and the communication quality can be enhanced.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. A printed antenna, comprising:

a radiating portion;

a capacitance matching portion disposed parallel to the radiating portion;

an inductance matching portion having one end electrically connected with the radiating portion and the other end electrically connected with the capacitance matching portion;

a feeding portion electrically connected with an inner side of the inductance matching portion and located among the capacitance matching portion, the inductance matching portion and the radiating portion, wherein the feeding portion is roughly perpendicular to the radiating portion; and a grounding portion electrically connected with an outer side of the inductance matching portion.

2. The printed antenna according to claim 1, wherein the inductance matching portion has a semi-circular shape, an arched shape or a horseshoe shape.

3. The printed antenna according to claim 1, wherein the grounding portion is electrically connected with an outer side of the radiating portion.

4. The printed antenna according to claim 3, wherein the grounding portion and the outer side of the radiating portion form an angle and the angle is ranged from 0 to 180 degrees.

5. The printed antenna according to claim 1, wherein the grounding portion is further electrically connected with an outer side of the capacitance matching portion and the grounding portion and the outer side of the capacitance matching portion form an angle and the angle is ranged from 0 to 180 degrees.

6. The printed antenna according to claim 1, further comprising:

a substrate having a surface, wherein the radiating portion, the capacitance matching portion, the inductance matching portion, the feeding portion and the grounding portion are disposed on the surface.

7. The printed antenna according to claim 1, wherein the printed antenna operates in a frequency band with a specification of IEEE 802.11, IEEE802.15 or IEEE 802.16.

8. The printed antenna according to claim 1, wherein the printed antenna is an antenna for a wireless communication system, a smart antenna system or a multi-input multi-output system.

9. The printed antenna according to claim 1, wherein the radiating portion, the capacitance matching portion, the inductance matching portion, the feeding portion and the grounding portion are integrally formed.

10. The printed antenna according to claim 1, wherein the radiating portion, the capacitance matching portion, the inductance matching portion, the feeding portion and the grounding portion are made of metal.

11. A printed antenna module, comprising:

a plurality of radiating portions;

a plurality of capacitance matching portions disposed parallel to the radiating portions, respectively;

a plurality of inductance matching portions, wherein each of the inductance matching portions has one end electrically connected with corresponding one of the radiating portions and the other end electrically connected with corresponding one of the capacitance matching portions;

a plurality of feeding portions, wherein each of the feeding portions is electrically connected with an inner side of corresponding one of the inductance matching portions and located among corresponding one of the capacitance matching portions, corresponding one of the inductance matching portions and corresponding one of the radiating portions, wherein the feeding portions are roughly perpendicular to the corresponding radiating portions;

a grounding portion electrically connected with outer sides of the inductance matching portions; and a substrate having a surface, wherein the radiating portions, the capacitance matching portions, the inductance matching portions, the feeding portions and the grounding portion are disposed on the surface.

12. The printed antenna module according to claim 11, wherein the inductance matching portion has a semi-circular shape, an arched shape or a horseshoe shape.

13. The printed antenna module according to claim 11, wherein the grounding portion is electrically connected with outer sides of the radiating portions and the grounding portion and the outer side of the radiating portion forms an angle and the angle is ranged from 0 to 180 degrees.

14. The printed antenna module according to claim 11, wherein the grounding portion is further electrically connected with outer sides of the capacitance matching portions.

15. The printed antenna module according to claim 13, wherein the grounding portion and the outer side of the capacitance matching portion form an angle and the angle is ranged from 0 to 180 degrees.

16. The printed antenna module according to claim 11, wherein the printed antenna module operates in a frequency band with a specification of IEEE 802.11, IEEE802.15 or IEEE 802.16.

17. The printed antenna module according to claim 11, wherein the printed antenna module is an antenna for a wireless communication system, a smart antenna system or a multi-input multi-output system.

18. The printed antenna module according to claim 11, wherein the radiating portions, the capacitance matching portions, the inductance matching portions, the feeding portions and the grounding portion are integrally formed.

19. The printed antenna module according to claim 11, wherein the radiating portions, the capacitance matching portions, the inductance matching portions, the feeding portions and the grounding portion are made of metal.

20. The printed antenna module according to claim 11, wherein the number of the radiating portions, the capacitance matching portions, the inductance matching portions or the feeding portions is ranged from 2 to 4.

* * * * *